United States Patent [19]

Wilcox et al.

[11] Patent Number: 4,552,628

[45] Date of Patent: Nov. 12, 1985

[54] PALLADIUM ELECTROPLATING AND BATH THEREOF

[75] Inventors: Jeannine Wilcox, North Plainfield; George A. Karustis, Westfield, both of N.J.

[73] Assignee: Engelhard Corporation, Iselin, N.J.

[21] Appl. No.: 584,282

[22] Filed: Feb. 27, 1984

Related U.S. Application Data

[63] Continuation-in-part of Ser. No. 416,412, Sep. 9, 1982, abandoned.

[51] Int. Cl.[4] ..... C25D 3/50

[52] U.S. Cl. ..... 204/47

[58] Field of Search ..... 204/47, 44.6, 109

[56] References Cited

U.S. PATENT DOCUMENTS

| | | | |
|---|---|---|---|
| 1,921,941 | 8/1933 | Powell et al. | 204/47 |
| 4,299,670 | 11/1981 | Yahalom | 204/29 |
| 4,316,779 | 2/1982 | Yahalom | 204/29 |

*Primary Examiner*—G. L. Kaplan

[57] ABSTRACT

Palladium electroplating baths comprising palladium in the form of a palladium tetraammine compound, sulfamate anions, optionally sulfate anions, at least some ammonium cations, and the balance of the cations, if any, being alkali metal cations, the bath operating at a pH of about 5 to 7. The bath is substantially free of both halides and thiourea.

23 Claims, No Drawings

PALLADIUM ELECTROPLATING AND BATH THEREOF

This application is a continuation-in-part of U.S. Ser. No. 416,412, filed Sept. 9, 1982 and now abandoned.

The present invention concerns an acidic, aqueous palladium electrolytic plating bath and methods of making and using the same for the electrolytic deposition of palladium.

Electrolytic deposition of palladium on base metal and other conductive substrates is well known in the art and the resulting plated products have numerous applications, including the preparation of electrical contact materials for switches and the like. Electrodeposited palladium coatings are typically utilized on low pressure electrical contacts such as those employed in conjunction with printed circuit boards. The low voltages and low contact pressures usually employed for such switches require a corrosion-resistant, and therefore precious metal-coated, contact material. Palladium plating baths of various types are known, including those prepared from halogenated palladium derivatives such as palladium tetraammine halides and palladium dichloro diammine hydroxide.

It is also known to provide palladium plating baths from complexes of palladium with organic compounds, for example, palladium cyclohexanediammine tetraacetate, palladium ethylenediammine chloride and the corresponding sulfate, as well as palladium urea salts. Palladium nitrite baths are also known, including palladium diamminodinitrite containing baths. For example, the assignee of this application has for many years past marketed an alkaline (pH of 7.5 to 9) palladium electroplating bath comprising palladium diamminodinitrite, sodium nitrite, ammonium sulfamate and sufficient ammonium hydroxide to attain the specified pH range. Generally, prior art palladium electroplating baths have had a neutral or basic pH since they were often unstable at acidic pH values, in that the bath components tend to precipitate uncontrollably. However, acidic palladium plating baths are known. For example, German (Federal Republic of Germany) Patent Application No. 2 105 626 discloses an acidic bath containing palladium nitrite and 5 to 20% palladium sulfite.

The utilization of palladium and palladium alloy plating baths which are substantially free of cyanide, nitrate and nitrite is also known, as disclosed in U.S. Pat. No. 3,933,602, which shows a bath comprising a palladium complex of the formula $Pd(SO_3)_2(NH_2)_2$, the bath having a pH of from 7 to 12.

A series of published British patent applications, Nos. 2,090,866 A, -867A, -868A and -869A, discloses baths for, and the electroplating of, thin, white palladium deposits. British application No. 2,090,866A discloses an electroplating bath comprising (1) a bath soluble source of palladium, which may be any palladium amine complex, including the nitrite, chloride or sulfate, (2) an ammonium conducting salt, which may be, e.g., ammonium sulfate or ammonium chloride, and (3) ammonium hydroxide in an amount sufficient to maintain a pH of about 8 to 10. In one embodiment, an electroplating bath of a preferred pH of 9 to 9.5 includes palladium diamminodinitrite, a conducting salt such as dibasic ammonium phosphate, ammonium hydroxide and, optionally a pH buffer.

British application No. 2,090,868A discloses an embodiment in which, in addition to the source of palladium and an ammonium conductivity salt, chloride ions and organic and/or inorganic brighteners are utilized, and in which the use of ammonium hydroxide is optional. A pH range of about 5–10 is disclosed and ammonium hydroxide is used when an alkaline bath within the disclosed range is required.

While numerous known baths have different strengths and weaknesses, it may be stated that many are of a rather complex formulation, are often difficult to properly replenish during operation of the bath, are relatively unstable, and require rather narrow ranges of operation to obtain consistent high quality deposits. The foregoing weaknesses are a particular problem in the relatively few prior art acid baths, which are often subject to sometimes sudden deterioration of the bath. Baths containing halides often result in insufficiently ductile, high stress deposits which often are insufficiently resistant to corrosion. Some bath ingredients tend to promote degradation of the bath due to side reactions among the components. Many prior art alkaline baths tend to evolve objectionable amounts of ammonia during operation.

In accordance with the present invention, there is provided a bath for electroplating palladium and comprising a substantially halide-free thiourea-free aqueous solution of: (a) a palladium tetraammine compound obtained by reacting $Pd(R)_2(NO_2)_2$ wherein R is $NH_3$ or an amine with ammonium hydroxide and present in at least an amount sufficient to electrodeposit palladium upon a workpiece in the bath; (b) sulfamate anions and optionally sulfate anions; (c) ammonium cations; and (d) optionally alkali metal cations; the bath having a pH from about 5 to 7, preferably 5.5 to 6.9, more preferably 6 to 6.9. The anions and cations are present in an amount at least sufficient to enhance the ductility of the palladium electrodeposited from the bath. In accordance with one aspect of the invention, the bath includes both sulfamate and sulfate anions in solution. At least about 25% of the cations, preferably at least 50%, more preferably at least 80%, and most preferably 100%, are ammonium. The balance of the cations may be any non-interfering species, generally alkali metal cations.

In preferred aspects of the invention, the palladium tetraammine compound is present in an amount sufficient to provide from about 1 to 30 g/l Pd in the bath, and the anions and cations are present in an aggregate amount of from about 10 to 200 g/l, though higher amounts may be used without deleteriously affecting the bath. When both sulfate and sulfamate anions are present, the weight ratio of sulfate anions to sulfamate anions is most preferably not more than about 4:1, preferably from about 4:1 to 2:3.

In a major aspect of the present invention, there is provided a method of electroplating a palladium deposit upon a workpiece, comprising the steps of: A. immersing a workpiece having an electrically conductive surface into an aqueous bath having a pH of from about 5 to 7, the bath comprising: (1) the palladium tetraammine compound as defined herein and present in an amount at least sufficient to electrodeposit palladium upon a workpiece in the bath; and (2) sulfamate anions and optionally sulfate anions; (3) ammonium cations; and (4) optionally alkali metal cations; B. applying an electrical potential across the workpiece and an anode immersed in the bath to provide a current density of from about 5 to 500 amperes per square foot to thereby electrodeposit palladium upon the workpiece; and C. removing the resultant electroplated workpiece from the bath. In a preferred aspect of the method, the bath includes both sulfamate and sulfate anions in solution. Most preferably all of the cations are ammonium. Other aspects of the invention are described in the following description of preferred embodiments.

The palladium utilized in the present invention is obtained by reacting a known material $Pd(R)_2(NO_2)_2$ wherein R is $NH_3$ or an amine such as an alkyl $C_{1-8}$ amine, an alkanol $C_{1-8}$ amine, substituted alkyl or alkanol amines, and the like; or the two R groups are derived from a polyamine such as ethylene diamine, propylene diamine, diethylenetriamine, and the like, with ammonium hydroxide to form the palladium tetraammine compound. The palladium dinitrite starting compounds are not soluble in water, but the tetraammine is. The reaction of the palladium dinitrite compound with ammonia in aqueous solution may be represented by the following equation, which shows the formation of the palladium tetraammine dihydroxide:

(1)

$$Pd(R)_2(NO_2)_2+4NH_4OH=Pd(R)_2(NH_3)_2(OH)_2+2NH_4NO_2+2H_2O$$

If the aqueous solution is acidic, most of the nitrite radical will evolve from the solution as a nitrogen oxide gas, whereas if the solution is on the alkaline side, the nitrite radical may react to form a nitrite salt or the like. Further, depending upon the temperature and the specific concentrations of other ingredients in the aqueous solution, a part or all of the hydroxyl moiety of the resultant tetraammine compound may be replaced by other species. It is believed that the reaction product of the palladium dinitrite compound with ammonium hydroxide has the general formula $$Pd(R)_2(NH_3)_2X_n$$

in which X may represent a hydroxyl group, a nitrite group, a sulfate group or a sulfamate group, and n will have a value, either 1 or 2, appropriate to the valence of the substituent group (n=1 for the sulfate group, and n=2 for each of the other three groups). Regardless of the specific configuration of the palladium tetraamine compound or complex, it has been found to be stable in an acidic aqueous plating bath and to provide excellent plating results as described in more detail below. The use of other palladium salts such as palladium acetate, sulfate or halides in lieu of the palladium diamminodinitrite has not been found to provide a bath of the same efficacy and desirable characteristics as that provided by the bath of the present invention. Reference herein and in the claims will be made to a "palladium tetraammine compound" by which term is meant the palladium reaction product as described above.

Generally, the bath of the present invention may contain any suitable concentration of the palladium tetraammine compound which is sufficient to provide a suitable electroplating rate. At very low palladium content of the bath, the rate of deposition of palladium becomes unsatisfactorily low. While, theoretically, any very small amounts of palladium contained in the bath could be plated, as a practical matter, the amount of the tetraammine compound present should be such as to provide at least about 1 gram per liter (g/l) in the bath. Lower levels of palladium could be utilized. On the other hand, the plating bath could theoretically contain as much of the palladium tetraammine compound as could be maintained in solution, but there is a practical upper limit which is also determined largely by economic factors. Because of the cost of palladium metal, economic as well as plating considerations dictate that the amount of tetraammine compound in the bath be not more than that sufficient to provide about 30 g/l palladium in the bath, preferably not more than about 20 g/l palladium. A Pd content of 4 to 20 g/l is preferred.

At relatively low concentrations of Pd in the bath, higher concentrations of the electrolyte ions may be desirable, with lower concentrations of electrolyte ions sufficing at higher Pd concentrations. As described below, the bath of the invention is a simple formulation and essentially comprises sulfamate and optionally sulfate anions, ammonium and optionally other cations in the solution together with the palladium compound. However, the bath may also contain a pH adjuster, such as one or more of sulfamic acid, sulfuric acid, and ammonium hydroxide in amounts as required to adjust the pH of the bath to within the specified pH range.

The ion component of the plating bath of the invention serves both as an electrolyte to enhance electrical conductivity of the bath and as an additive to provide enhanced ductility of the palladium electrodeposit. A fairly wide range of concentration of the ion component in the bath has been found to be operative in the practice of the invention. Generally, from about 10 to 200 grams per liter (g/l) of total ion content has been found to be satisfactory. For the cation component, at least 25%, preferably 50%, more preferably 80%, and most preferably 100% of the cations should be ammonium. The balance, if any, may be any noninterfering species, preferably alkali metal cations. For example, about 38 g/l ammonium sulfamate and 25 g/l ammonium sulfate is a most preferred content of total electrolyte salts.

Although an adherent, ductile palladium deposit is obtained with a plating bath comprising the palladium tetraammine compound and sulfamate ions, the resultant palladium deposits, while possessing a reasonable sheen, are not always fully bright deposits. It is commercially advantageous to be able to uniformly produce a bright palladium deposit. It has also been found that the addition of an effective amount of a combination of sulfamate and sulfate anions to the bath composition not only provides a part of the desired enhanced electrical conductivity of the bath, but imparts a desired brightness to the palladium deposit obtained.

Insofar as the total amount of electrolyte ions, i.e., sulfamate anions, optionally sulfate anions, and ammonium cations with or without other cations, in the bath is concerned, the aggregate amount of the electrolyte ions present should be substantially the same as that when sulfamate anions are utilized in the absence of sulfate anions. This is, the aggregate amount of electrolyte ions present in the bath composition should be from about 10 to 200 g/l. When both the sulfamate and sulfate anions are employed, at least one fifth by weight of the total weight of anions should be comprised by the sulfamate in order to assure sufficient ductility of the resultant palladium deposit. In other words, the weight ratio of the sulfate to sulfamate should be not greater than about 4:1. Most preferably, the sulfamate may comprise up to about three fifths by weight of the total of sulfate present, i.e., the weight ratio of sulfate to sulfamate may be up to 2:3. The sulfamate and sulfate may be present in equal weight proportions in one preferred embodiment.

The bath of the present invention is prepared simply by dissolving required amounts of the palladium tetraammine compound, ammonium or alkali metal sulfamate and optionally ammonium or alkali metal sulfate, in water. The palladium tetraammine compound may be obtained by solubilizing the appropriate palladium dinitrite compound with ammonium hydroxide. It is immaterial whether the palladium tetraammine compound is prepared in advance and the electrolyte salt or salts added to a solution of the tetraammine compound, or if the electrolyte salt or salts are already in solution when the tetraammine compound or the precursor palladium salt and ammonium hydroxide are added thereto. The palladium tetraammine compound need not be freshly prepared in preparing the plating bath of the invention, since it has exhibited shelf-life stability of over six months.

Any suitable ingredient or ingredients to adjust the pH of the bath to the desired level may be utilized, so long as it does not adversely affect or interfere with the operation of the palladium bath. Sulfuric acid is preferred for acidifying the bath, although sulfamic acid may also be employed for this purpose, and ammonium hydroxide is preferred for alkalizing the bath.

One of the advantages of the present invention is the simplicity and stability of the halide-free thiourea-free palladium plating bath provided. However, other additives of the type normally utilized in palladium plating baths, such as pH buffers, brighteners, surfactants and the like may be incorporated. However, such have been found not to be necessary and it is preferred not to complicate the bath by using them. For example, it is conventional in many palladium plating baths to employ an amine or imine type brightener such as polyethyleneimine and such brightener (or other conventional additives) may be utilized. However, as noted above, it has been found that the use of the preferred combination of sulfamate and sulfate to provide the anion portion of the electrolyte salt component of the bath effectively minimizes the need for an additional brightener component.

As mentioned above, previous palladium electroplating baths were generally operated at an alkaline pH. Those few palladium electroplating baths which are operated at acidic pH are usually rather complex and/or unstable and require relatively very low pH ranges for successful operation. It has surprisingly been found that the bath of the present invention may be operated within a moderately acid pH range, is quite stable at such acid pH levels and gives excellent plating results even at extraordinarily high plating rates. Generally, the bath of the present invention may be usefully operated over a pH range of from about 5 to 7. At a pH level lower than about 5, problems of poor adherence of the palladium electrodeposit to the workpiece or substrate may occur. At alkaline pH levels, there is a drop-off in plating efficiency and very high plating rates cannot be sustained. Further, emanation of noxious fumes (ammonia) are increased in an alkaline bath. In order to reduce the effect of these adverse aspects encountered at the extremities of the broader pH range, it is preferred to operate within a somewhat narrower pH range of about 5.5 to about 6.9, more preferably at a pH range of from about 6 to 6.9. Within these ranges, the highest plating efficiencies are noted, the emanation of noxious fumes from the plating bath is significantly reduced as compared to higher levels, and the slightly acidic condition of the bath tends to keep the workpieces being plated active.

Both the operating temperature and the pH level of the bath affect the plating efficiency, which may be defined as the weight percent of palladium in the bath which is ultimately deposited on the workpiece per unit of current compared to that which could be deposited if all the current were consumed by the deposition process. As is well known, palladium is an excellent absorbent for hydrogen and, generally, deposition efficiency varies inversely with the rate of hydrogen generated in the electroplating reaction. Hydrogen absorbed in the palladium electrodeposit tends to evolve after deposition, resulting in the formation of cracks and fissures in the palladium electrodeposit. Higher plating efficiency is therefore desirable as not only providing a more economic operation, but in providing a better quality palladium deposit because of the reduction in hydrogen absorption.

The palladium plating bath of the present invention is utilized by immersing the workpiece to be plated within the bath, together with a plating anode, and applying an electrical potential across the workpiece and the anode to provide a desired level of current density at the surfaces of the workpiece. Any suitable workpiece may be electroplated with palladium. At least the surface of the workpiece must be electrically conductive and the workpiece may be prepared by known techniques to provide a surface on which the palladium electrodeposit will adhere in the desired thickness, which typically may be from about 2 millionths of one inch, up to several mils. Depending upon the nature of the substrate to be plated, it may be prepared, for example, by depositing a thin nickel strike prior to application of the palladium electrodeposit thereover. A wide range of current densities at the workpiece surface may be employed and, generally, the higher the current density, the higher is the rate of deposition of palladium. The palladium acidic plating bath of the present invention has demonstrated the ability to be plated at surprisingly high plating rates with good efficiency. At the acid pH levels in laboratory tests, plating current densities of as high as 80 amperes per square foot have been employed to attain very high speed plating of adherent, bright deposits. In selective plating machines with high agitation, current densities up to about 500 amperes per square foot may be used.

The bath of the invention may readily be replenished simply by additions of electrolyte salts and the palladium tetraammine compound, as required. Any pH adjustments needed are attained by additions of such as sulfuric or sulfamic acids or ammonium hydroxide.

Generally, the moderately acidic and substantially halide-free plating baths of the invention are simple, stable and provide surprisingly high plating efficiencies and bright low-stress palladium deposits without the need for auxilliary brighteners. Further, they can be operated with substantially lower concentrations of conducting salts than can alkaline baths, usually only about one-half the amount of conducting salts needed for alkaline baths being required for comparable operation of otherwise identical acid baths.

EXAMPLE 1

109.2 grams of palladium diammino dinitrite are added to 350 milliliters of a solution of ammonium hydroxide (28% by weight $NH_4OH$ in water). The palladium salt reacts with the ammonium hydroxide to form what is believed to be palladium tetraammine dihydroxide in solution. It is diluted to 1 liter having 50 g/l palladium to form a stock solution. Separately, 24.8 grams of ammonium sulfate and 37.2 grams of ammonium sulfamate are dissolved in 500 ml of water to form a concentrated electrolyte salt solution. To the concentrated electrolyte salt solution is added 200 ml of the palladium tetraammine stock solution, and sufficient water is added to the mixed solutions to provide a palladium electroplating bath containing 10 g/l palladium and a total of 62 g/l conducting salts. The pH of the solution is adjusted with dilute (10%) sulfuric acid as required to bring the finished plating bath to a pH of 6.5.

The resulting formulation, and typical plating conditions for its use, are:

pH: 6.5
Current Density: 10 amperes per square foot
Pd Content: 10 g/l Plating Temperature 55° C.
Conducting Salt: 62 g/l (weight ratio of ammonium sulfamate:ammonium sulfate=3:2).

EXAMPLE 2

For comparison, an alkaline version of the bath of Example 1 is made by following the procedure of Example 1, except that the amounts of electrolyte salts are adjusted to provide a total of 125 g/l electrolyte salts in solution, the ammonium sulfate and ammonium sulfamate being in the same weight proportion as in the bath of Example 1, and ammonium hydroxide or dilute (10%) sulfuric acid is added as required to adjust the finished plating bath to a pH of 8.0.

The resulting formulation, and typical plating conditions for its use are:

pH: 8.0
Current Density: 10 amperes per square foot
Pd Content: 10 g/l
Plating Temperature: 25° C.
Conducting Salt: 125 g/l (weight of ammonium sulfamate:ammonium sulfate=3:2).

EXAMPLE 3

The acidic bath of Example 1 is utilized to plate palladium on brass workpieces comprising brass tabs measuring 3 by 1 by 0.012 inches. The brass tabs were cleaned with an alkaline cleaning solution comprising trisodium phosphate and a suitable detergent in water, thoroughly rinsed and then dipped in a 10% $H_2SO_4$ solution and rinsed in order to provide bright, clean surfaces on them. The brass tabs and a suitable plating anode are immersed in the bath, the tabs are reciprocated parallel to the anode at a rate of about 20 times per minute, and an electrical potential is applied across the anode and the tabs in the conventional manner.

As indicated in the following table, one of the pH, current density and palladium metal content was adjusted during the course of plating a sequence of brass tabs, while the other parameters were held constant at the values indicated in the "formulation and typical plating conditions" of Example 1. The following results were obtained.

TABLE

| | (Example 3) Appearance of Palladium Electrodeposit | Plating Efficiency |
|---|---|---|
| Current Density Variable | | |
| 5 ASF[1] | [2]Bright/Haze Near Clip | 81% |
| 10 ASF | Bright | 84% |
| 20 ASF | Bright | 95% |
| 30 ASF | [2]Bright/Burn Opposite Clip | 85% |

TABLE-continued

| | (Example 3) Appearance of Palladium Electrodeposit | Plating Efficiency |
|---|---|---|
| 40 ASF | Bright | 87% |
| 50 ASF | [2]Bright/Burn Opposite Clip | 89% |
| 60 ASF | Bright | 100% |
| 80 ASF | Marginally Bright | 97% |
| 100 ASF | Considerable Burn | 85% |
| Temperature Variable | | |
| Room Temp | Bright | 87% |
| 35° C. | Bright | 100% |
| 45° C. | Bright | 92% |
| 65° C. | Bright | 90% |
| Pd Content Variable | | |
| 4 g/l | Dull | 92% |
| 8 g/l | Bright | 88% |
| 12 g/l | Bright | 92% |
| 16 g/l | Bright | 94% |
| 20 g/l | Bright | 88% |

[1]ASF = amperes per square foot
[2]Slight haze or burns, not serious defects, and apparently correctable.

Extremely high plating efficiencies were obtained with the acid bath as demonstrated by Example 3. It is unusual and surprising that uniformly high plating efficiencies were maintained over a very wide range of palladium metal content and that good palladium deposits and high efficiencies were obtained at current densities up to 80 amperes per square foot.

EXAMPLE 4

The alkaline comparison bath of Example 2 is utilized to plate palladium on brass tabs as in Exammple 3. As indicated in the following table, one of current density, temperature and palladium content was adjusted during the course of plating a sequence of brass tabs, while the other parameters were held constant at the values indicated in the "formulation and typical plating conditions" of Example 2. The following results were obtained.

TABLE

| | (Example 4) Appearance of Palladium Electrodeposit | Plating Efficiency |
|---|---|---|
| pH Variable[*] | | |
| 7.5 | Bright | 75.5% |
| 8.0 | Bright | 69.4% |
| 8.5 | Bright | 69.2% |
| 9.0 | Bright | 62.4% |
| Current Density Variable | | |
| 5 ASF[*] | Bright | 74.0% |
| 10 ASF | Bright | 69.4% |
| 20 ASF | Marginally Bright | 66.7% |
| 30 ASF | Coarse Deposit Near Clip | 59.7% |
| Pd Content Variable | | |
| 4 g/l | Bright | 62% |
| 8 g/l | Bright | 67.7% |
| 10 g/l | Bright | 69.4% |
| 12 g/l | Bright | 67% |
| 15 g/l | Bright | 74.2% |
| 20 g/l | Bright | 73% |

[*]Adjusted with ammonium hydroxide or dilute sulfuric acid, as required.
[*]ASF = Amperes per square foot While Example 4 shows adequate plating efficiencies for an alkaline bath, they are significantly lower than those attained by the acid bath of this invention shown in Example 3. Bright, adherent palladium electrodeposits were also attained by the bath of Example 4. Temperature was not varied for the alkaline baths does not provide any significant benefit and results in a higher rate of evolution of noxious fumes.

As indicated by the above examples, the ammonium sulfamate and ammonium sulfate employed as the electrolyte salt system provides, with the palladium tetraammine compound, a highly efficient, simple and stable moderately acidic palladium plating bath which yields bright, adherent, ductile, low stress palladium deposits.

EXAMPLE 5

The procedure of Examples 1 and 3 was repeated while varying the palladium tetraammine compound content, the ammonium sulfate content, the ammonium chloride content, the plating temperature, the current density (C.D.) and the pH of the plating bath.

The compositions, expressed in grams/liter, plating conditions, and results were as follows:

TABLE (Example 5)

| Composition | | | Plating Conditions Results | | | | |
|---|---|---|---|---|---|---|---|
| Pd | $(NH_4)S_2O_4$ | $NH^4$ $SO_3NH_2$ | T °C. | pH | C.D. | Eff. | Appear. |
| 5.5 | 16 | 25 | 28 | 6.5 | 15 | 98.46 | Sl. Haze |
| 11 | 33.2 | 50 | 28 | 6.5 | 10 | 89.1 | Most Bright |
| 11 | 33.2 | 50 | 45 | 6.5 | 10 | — | Bright |
| 11 | 33.2 | 50 | 52 | 6.5 | 10 | — | Bright |
| 11 | 33.2 | 50 | 65 | 6.5 | 10 | — | Bright |
| 11 | 33.2 | 50 | 65 | 6.5 | 20 | — | Bright |
| 10 | 25 | 37.5 | 46 | 5 | 10 | 100 | Bright but poor Adhesion |

EXAMPLE 6

The procedures of Examples 1 and 3 were repeated except varying the anions and cations and their amounts in the bath. The compositions all contained 10 g/l palladium; the plating was done at a temperature of 40°–45° C., a current density of 10 amperes per square foot, and a pH of 6.5. The ion content and the results were as follows:

| Cation, g/l | | Anion, g/l | | Results | |
|---|---|---|---|---|---|
| $NH_4^+$ | $K^+$ | $SO_3NH_2^-$ | $SO_4^=$ | Efficiency | Appearance |
| 3.9 | — | 21.1 | — | 99 | Bright |
| 7.8 | — | 42.2 | — | 99 | Bright |
| 11.7 | — | 63.3 | — | 94 | Bright |
| 15.6 | — | 84.4 | — | 92 | Bright |
| 6.8 | — | — | 18.2 | 100 | Bright |
| 13.6 | — | — | 36.4 | 99 | Bright |
| 20.4 | — | — | 54.6 | 90.4 | Bright |
| 27.2 | — | — | 72.8 | 99 | Bright |
| — | 9.2 | 8.9 | 6.9 | Bath Decomposed | |
| 3.4 | 3.6 | 8.9 | 9.1 | 97 | Bright |
| 6.8 | 7.2 | 17.8 | 18.2 | 99 | Bright |
| 10.2 | 10.8 | 26.7 | 27.3 | 99 | Bright |
| 13.6 | 14.4 | 35.6 | 36.4 | 96 | Bright White |

The baths containing only sulfate anions precipitated as a white flocculant when the pH was adjusted to 6.5 and are thus unsatisfactory for commercial use.

EXAMPLE 7

The procedure of Examples 1 and 3 was repeated to perform a five variable factorial study wherein the variables and their high and low values were as follows:

| Variable | High | Low |
|---|---|---|
| Pd content | 20 g/l | 5 g/l |
| Current density | 40 ASF | 5 ASF |
| Temperature | 65° C. | 25° C. |
| Ammonium Sulfamate | 75 g/l | 18.75 g/l |
| Ammonium Sulfate | 50 g/l | 12.5 g/l |

All of the variations produced uniformly high deposits at pH 6.5 when plated though there was a slight tendency toward bath decomposition when the palladium content was at the high value and the other values were at the low value.

EXAMPLE 8

The procedure of Examples 1 and 3 was repeated except that the ammonium sulfate and ammonium sulfamate were replaced by various other salts and the sulfuric acid used for pH adjustment was replaced by the appropriate acid of the new salt being evaluated in the bath. The salts tested were:

(1) ammonium citrate
(2) ammonium phosphate
(3) ammonium bromide
(4) ammonium acetate and
(5) potassium oxalate Each bath contained 10 g/l Pd as the palladium tetrammine compound, had a pH of 6.5, was operated at 60°–65° C. since the salts fell out of solution at lower temperatures except for the acetate system, and ran at a current density of 10 amperes per square foot for 10 minutes. The results were as follows:

| Concentration, g/l | Efficiency | Appearance |
|---|---|---|
| | (1) Citrate | |
| 25 | 66.96 | Blistered in high C.D. areas |
| 50 | 82 | Less blistering |
| 75 | 79.9 | Slight blistering |
| 100 | 51.85 | Very slight blistering but poor adhesion |
| | (2) Phosphate | |
| 25 | 58.09 | Slight haze |
| 50 | 60.13 | Brighter |
| 75 | 54.32 | Bright |
| 100 | 47.0 | Bright |
| | (3) Bromide | |
| 25 | 100 | Dark matter |
| 50 | 100 | Darker matter |
| 75 | 100 | Lighter matter |
| 100 | 100 | Streaky, ugly |
| | (4) Acetate | |
| 25 | 73.64 | Blistered, bright in low current density areas |
| 50 | 67.98 | Blistered, bright in low current density areas |
| 75 | 59.99 | Bright, haze on edges |

-continued

| Concentration, g/l | Efficiency | Appearance |
|---|---|---|
| 100 | 69.3 | Swirled haze |
| | (5) Oxalate | |
| 25 | 96 | Bright in center, other blistered |
| 50 | 89.76 | Blister in high current density |
| 75 | 91.79 | More blistering |
| 100 | 97.36 | Blistered, ext. stress on edges |

EXAMPLE 9

The procedures of Examples 1 and 3 were repeated except that the palladium tetraamine compound (218 g) was reacted with monoethanolamine (12.5 g) by gentle heating prior to formation of the plating bath. The electrolyte was a 50/50 mixture of ammonium sulfate and ammonium sulfamate, and sulfamic acid was used to adjust the pH to 6.0.

Deposits were produced at 10 and 20 amperes per square foot at temperatures of 25°, 35°, 45° and 55° C. All were bright, stress free, and had an efficiency of 60–70%.

EXAMPLE 10

The procedure of Example 9 was repeated except that the monoethanolamine was replaced with diethanolamine. Similar plating results occured.

While the invention has been described in detail with respect to specific embodiments thereof, it will be appreciated by those skilled in the art that upon a reading and understanding of the foregoing, other embodiments may occur to the skilled practitioner. Such other embodiments are nonetheless believed to be within the spirit and scope of the invention.

We claim:

1. An aqueous acidic bath for electroplating palladium comprising a substantially halide-free and thiourea-free aqueous solution of: (a) a palladium tetraammine compound obtained by reacting $Pd(R)_2(NO_2)_2$, wherein R is $NH_3$ or an amine, with ammonium hydroxide; (b) sulfamate anions; (c) ammonium cations; and (d) optionally alkali metal cations; wherein at least 25% of the cations are ammonium, said bath has a pH from about 5 to 7.

2. The bath of claim 1 wherein R is $NH_3$.

3. The bath of claim 1 wherein R is selected from the group consisting of alkyl $C_{1-8}$ amines, alkanol $C_{1-8}$ amines, substituted alkyl $C_{1-8}$ and alkanol $C_{1-8}$ amines, and a polyamine.

4. The bath of claim 1 further containing sulfate anions.

5. The bath of claim 4 wherein the weight ratio of sulfate anions to sulfamate anions is not greater than about 4:1.

6. The bath of claim 4 wherein the weight ratio of sulfate anions to sulfamate anions is from about 4:1 to 2:3.

7. The bath of claim 1 wherein at least 50% of the cations are ammonium.

8. The bath of claim 1 wherein at least 80% of the cations are ammonium.

9. The bath of claim 1 wherein substantially all of the cations are ammonium.

10. The bath of claim 1 wherein said palladium tetraammine compound is present in an amount sufficient to provide from about 1 to 30 g/l Pd in said bath, the aggregate amount of cations and anions present is from about 10 to 200 g/l, and the pH of said bath is from about 5.5 to 6.9.

11. The bath of claim 1 wherein the pH is from about 6 to 6.9.

12. The bath of claim 1 including one or more of sulfuric acid, sulfamic acid and ammonium hydroxide in amounts as required to adjust the pH of said bath to within the defined range.

13. In the method of electroplating a palladium deposit upon a workpiece, the steps comprising:

A. immersing a workpiece having an electrically conductive surface into a substantially halide-free, thiourea-free acidic aqueous bath having a pH of from about 5 to 7, said bath comprising: (1) a palladium tetraammine compound obtained by reacting $Pd(R)_2(NO_2)_2$, wherein R is $NH_3$ or an amine, with ammonium hydroxide, and present in at least an amount sufficient to electrodeposit palladium upon a workpiece in said bath; (2) sulfamate anions and optionally sulfate anions; (3) ammonium cations; and (4) optionally alkali metal cations; wherein at least 25% of the cations are ammonium;

B. applying an electrical potential across said workpiece and an anode immersed in said bath to provide a current density of from about 5 to 500 amperes per square foot to thereby electrodeposit palladium upon said workpiece; and C. removing the resultant electroplated workpiece from said bath.

14. The method of claim 13 wherein R is $NH_3$.

15. The method of claim 13 wherein R is selected from the group consisting of alkyl $C_{1-8}$ amines, alkanol $C_{1-8}$ amines, substituted alkyl $C_{1-8}$ and alkanol $C_{1-8}$ amines and a polyamine.

16. The method of claim 13 further containing sulfate anions.

17. The method of claim 16 wherein the weight ratio of sulfate anions to sulfamate anions in said bath is not greater than about 4:1.

18. The method of claim 17 wherein the weight ratio of ammonium sulfate to ammonium sulfamate in said bath is from about 4:1 to 2:3.

19. The method of claim 13 wherein at least 80% of the cations are ammonium.

20. The method of claim 13 wherein substantially all of the cations are ammonium.

21. The method of claim 13 including maintaining the current density within the range of from about 5 to 80 amperes per square foot.

22. The method of claim 13 including maintaining the pH of said bath within the range of from about 6.0 to 6.9.

23. The method of claim 13 wherein said palladium tetraammine compound is present in an amount sufficient to provide from about 1 to 30 g/l Pd in said bath, said anions and cations are present in an aggregate amount of from about 10 to 200 g/l, and the pH of said bath is from about 5.5 to 6.9.

* * * * *